United States Patent [19]

Jackson

[11] 4,412,676

[45] Nov. 1, 1983

[54] VISE FOR WORKBENCH

[75] Inventor: Ronald A. Jackson, Brockville, Canada

[73] Assignee: Black & Decker Inc., Newark, Del.

[21] Appl. No.: 334,453

[22] Filed: Dec. 24, 1981

[51] Int. Cl.[3] ..... B25B 1/22

[52] U.S. Cl. ..... 269/101; 269/139; 269/220; 269/208; 269/244; 269/282; 269/95

[58] Field of Search ..... 269/139, 208, 219–222, 269/283, 282, 99–101, 95, 244, 212, 901; 144/286 R

[56] References Cited

U.S. PATENT DOCUMENTS

| | | | |
|---|---|---|---|
| 68,215 | 8/1867 | Lee | 269/244 |
| 207,349 | 8/1878 | Dutton | 269/139 |
| 825,151 | 7/1906 | McLean | 269/244 |
| 1,298,146 | 3/1919 | Yost | 269/139 |
| 1,418,733 | 6/1922 | Petterson | 269/139 |
| 2,480,415 | 8/1949 | Mettler | 269/283 |
| 2,770,156 | 11/1956 | Brettrager | 269/283 |
| 4,002,328 | 1/1977 | Wolf et al. | 269/97 |
| 4,061,323 | 12/1977 | Beekenkamp . | |
| 4,154,435 | 5/1979 | Alessio . | |
| 4,155,386 | 5/1979 | Alessio . | |
| 4,184,667 | 1/1980 | Alessio . | |
| 4,239,195 | 12/1980 | Oltman et al. | 269/212 |
| 4,278,243 | 7/1981 | Alessio . | |

FOREIGN PATENT DOCUMENTS

| | | | |
|---|---|---|---|
| 2063111 | 6/1981 | United Kingdom | 269/283 |

*Primary Examiner*—Robert C. Watson
*Attorney, Agent, or Firm*—R. B. Sherer; Harold Weinstein; Charles E. Yocum

[57] ABSTRACT

A vise is cantilever mounted to a workbench, projects forwardly thereof, and is disposed below the extended plane of the workbench table top. The vise includes a pair of U-shaped brackets, secured to the underside of the table top, and a pair of tubular beams slidably received in the respective brackets. Each of the beams is selectively indexed to its cooperating bracket, thereby providing a "coarse" adjustment. A fixed rear vise jaw is disposed on top of the beams, transversely thereof; this rear vise jaw is secured to the brackets and abuts against the lower portion of the longitudinal front side of the table top. A movable front vise jaw is mounted on top of the beams, transversely thereof, and may be moved in a non-parallel relationship with respect to the fixed rear vise jaw for clamping tapered workpieces therebetween. The means for mounting the movable front jaw to the beams includes a pair of independently-operable screw-threaded rods in the beams, restrained against axial movement thereof, and carrying respective crank handles. The rods are received in respective pivot nut members secured to the movable front vise jaw.

2 Claims, 6 Drawing Figures

VISE FOR WORKBENCH

BACKGROUND OF THE INVENTION

Workbenches have traditionally employed a vise for gripping workpieces. The vise is usually mounted at the left front side of the workbench. Various forms of vises have been disclosed for use by machinists, carpenters and other craftsmen. The machinist's vise is usually a heavy metal vise mounted on top of the workbench and consists of a fixed front jaw and a movable rear jaw, the latter actuated by means of a screw-threaded rod connected to a crank handle. The carpenter's vise, on the other hand, is usually mounted beneath the table top and includes a pair of vise jaws formed from hard wood. Like the machinist's vise, the carpenter's vise is actuated by a crank handle and a screw-threaded rod connected to the moving jaw, which is usually the front jaw. Because of the centrally-disposed screw-threaded rod, a "drop through" clamping of relatively-large workpieces is not possible; and thus the capacity of these vises is necessarily restricted. In summary, the vises currently available on the market for use with stationary workbenches are relatively heavy, cumbersome and expensive; nor is there any provision for clamping relatively large, tapered or odd-shaped workpieces.

In other prior art, of which I am aware, a portable workbench with an integral vise has been disclosed in a number of prior teachings, such as in U.S. Pat. No. 4,154,435 issued on May 15, 1979. In this '435 patent, a pair of independently-operable screw-threaded rods are connected to a movable (and articulatable) front vise jaw in such a manner that the front vise jaw is movable in a non-parallel relationship with respect to a rear vise jaw mounted on the table top. With this arrangement, odd-shaped or tapered objects may be clamped between the vise jaws. The jaws are mounted on top of a foldable and portable supporting structure, and are arranged transversely to a pair of supporting beams. While the rear vise jaw is fixed to the beams, its position relative thereto may be adjusted by a first indexing means having a predetermined number of selected positions. These positions are defined by a bolt or pin carried by the jaw and received within a selected one of a series of spaced openings formed in the supporting beams. This first indexing means thereby provides for a "coarse" adjustment between the vise jaws; and the screw-threaded rods provide for the "fine" adjustment, that is, the final clamping pressure exerted on a workpiece placed between the vise jaws. Moreover, the front movable jaw is pivotable with respect to the supporting frame, and its position relative to the frame is selected by a second indexing means. This second indexing means comprises a spring-loaded pin carried by the jaw, a knob mounted on the pin to facilitate convenient operation, and a plurality of openings in the frame to receive the pin in a desired angularly-adjusted position of the movable jaw relative to the frame.

SUMMARY OF THE INVENTION

It is an object of the present invention to provide a vise for a workbench, the vise being readily cantilever mounted to the underside of the workbench and projecting forwardly thereof below the plane of the table top, wherein the vise is relatively compact, lightweight and inexpensive.

It is another object of the present invention to provide a vise for a workbench, suitable for use by carpenters, machinists and other craftsmen, wherein the vise has a quick adjustment and yet is adapted for clamping tapered or odd-shaped workpieces.

It is yet another object of the present invention to provide a vise for a workbench featuring "drop through" clamping of relatively large workpieces.

It is a further object of the present invention to provide a vise for a workbench, wherein the size of the longitudinal vise jaws may be readily changed in production, thereby facilitating the market introduction of an entire product line having a large proportion of standardized components.

It is a still further object of the present invention to provide a vise which may be assembled in production quickly and economically from a variety of components, some of which are simple stamped sheet-metal parts, and the rest of which are readily-available from other products.

In accordance with the teachings of the present invention, a vise is provided which includes a pair of spaced brackets secured to the underside of the table top of a workbench. A pair of parallel beams are slidably received telescopically within the respective brackets. An indexing means between the beams and brackets provides a plurality of coarse adjustments therebetween. A longitudinally-extending rear vise jaw is disposed above the beams, transversely thereof, and is fixed to the brackets. When the vise is mounted to the bench, the fixed rear vise jaw abuts against the lower portion of the longitudinal front edge of the table top. With this arrangement, the vise is cantilever mounted to the bench and projects forwardly thereof beneath the extended plane of the table top. A longitudinally-extending movable front vise jaw is slidably disposed on top of the beams, transversely thereof. Means are provided for mounting the movable front vise jaw on the beams for movement towards and away from the fixed rear vise jaw in a non-parallel relationship thereto, whereby a tapered workpiece may be clamped between the jaws. Preferably, this means includes a pair of independently-operable screw-threaded rods mounted within the respective beams, a pair of pivot nut members carried by the movable front vise jaw for receiving the respective rods, and a crank handle carried by each of the rods forwardly of the beams.

These and other objects of the present invention will become apparent from a reading of the following description, taken in conjunction with the enclosed drawings.

DESCRIPTION OF THE PREFERRED EMBODIMENT

Figures 1, 2, 3, 4:
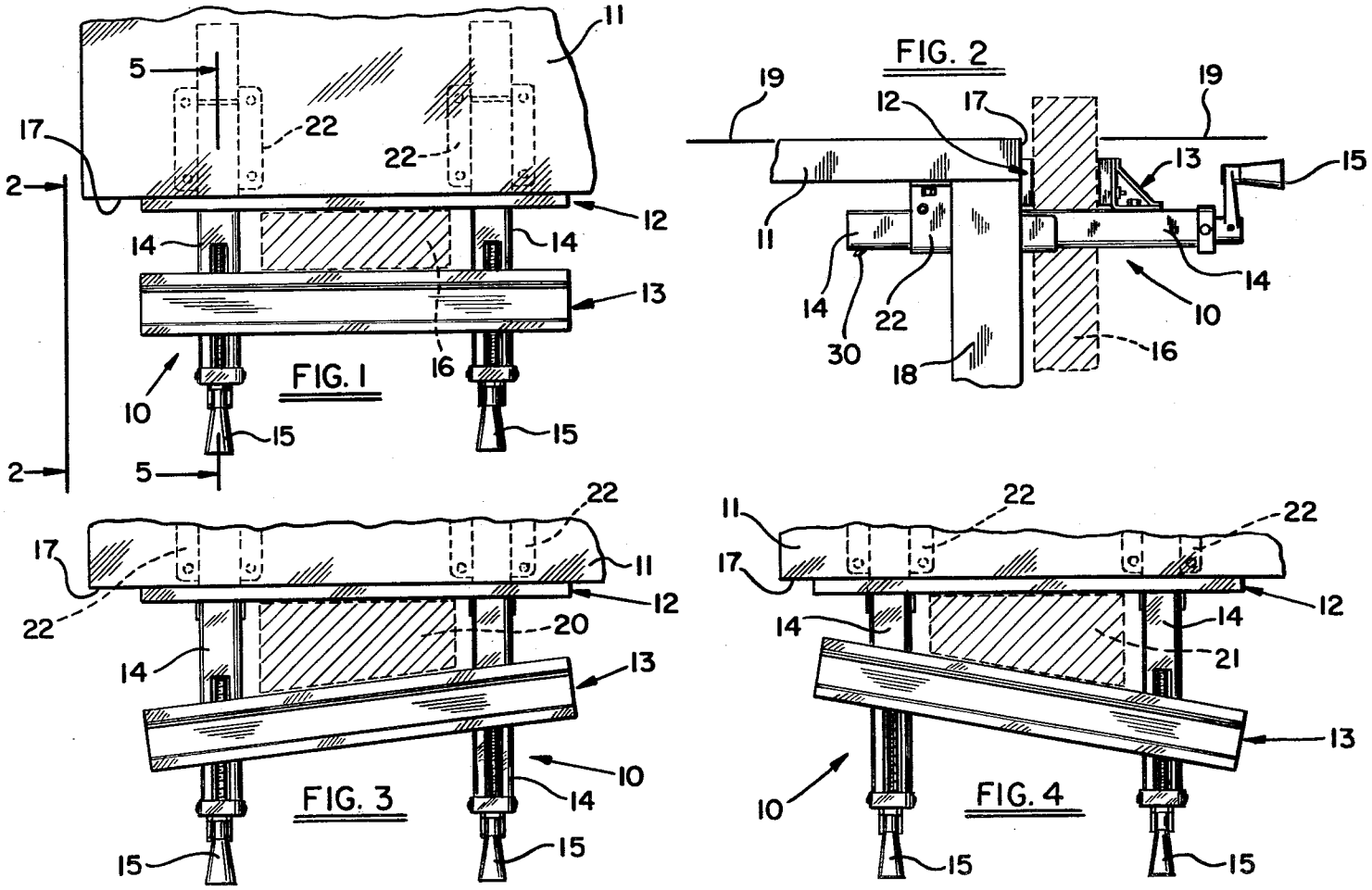
FIG. 1 is a top plan view of the vise mounted to the underside of the table top of a workbench, the latter shown in fragmentary form.
FIG. 2 is a side elevation of the vise, taken along the lines 2—2 of FIG. 1, and showing the vise mounted below the extended plane of the table top.
FIG. 3 corresponds to a portion of FIG. 1, but shows a tapered workpiece gripped by the vise.
FIG. 4 corresponds to FIG. 3, but shows the maximum alternate position of the movable front vise jaw with respect to the fixed rear vise jaw.

With reference to FIGS. 1 and 2, the vise 10 is adapted to be mounted to the underside of a table top 11 of a typical workbench. The vise includes a fixed rear vise jaw 12 and a movable front vise jaw 13. The vise jaws are longitudinally extending and are disposed above a pair of beams 14, transversely thereof. A pair of crank handles 15 may be manipulated for bringing the jaws together to grip a workpiece 16 therebetween. The fixed rear vise jaws abuts against the lower portion of the longitudinal front edge 17 of the table top. The vise is cantilever mounted to the bench inwardly of the leg 18 thereof, projects forwardly of the bench, and is disposed below the extended plane 19 of the table top as shown in FIG. 2.

With reference to FIGS. 3 and 4, the crank handles are independently operable and are so connected to the movable front vise jaw (as hereinafter described) for purposes of clamping odd shaped or tapered workpieces 20 and 21 between the vise jaws. Moreover, relatively large workpieces may be disposed between the beams for "drop through" clamping between the vise jaws.

Figure 5:
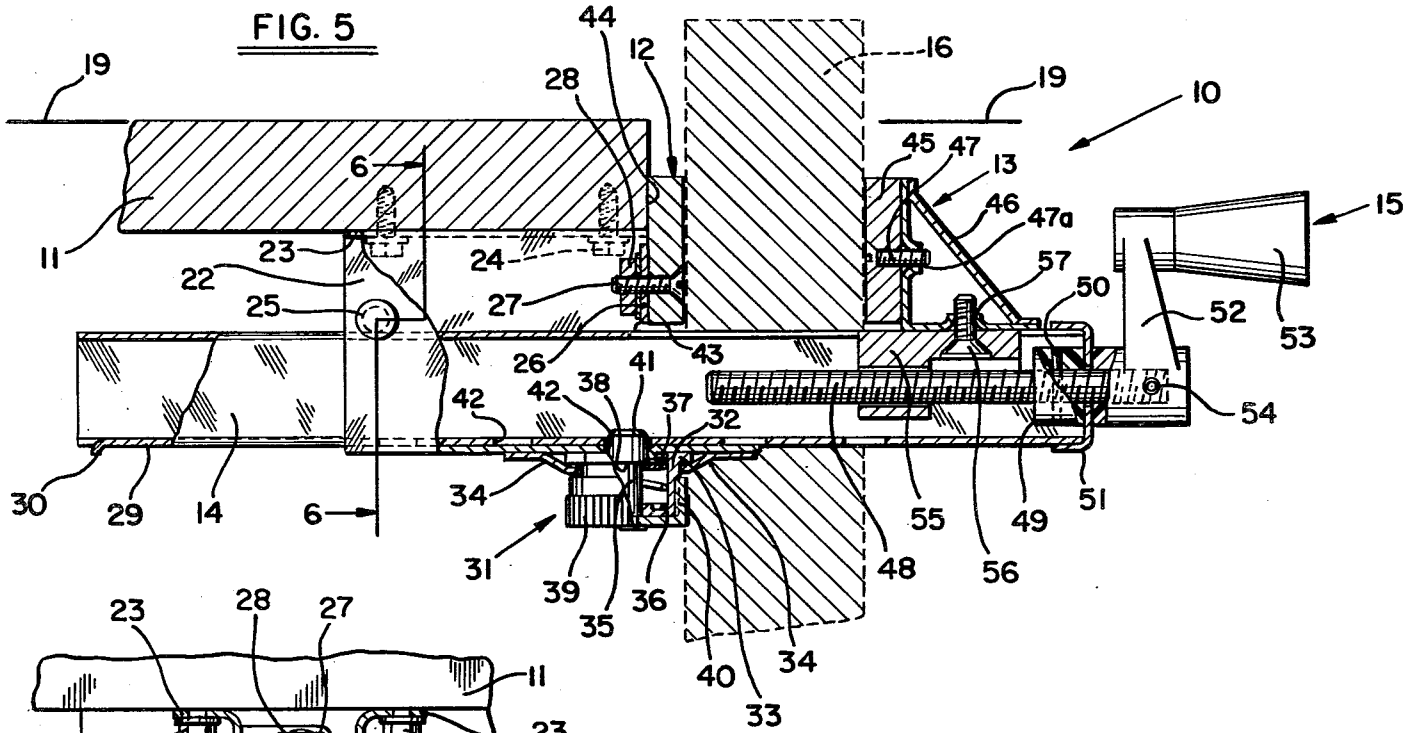
FIG. 5 is a section view taken along the lines 5—5 of FIG. 1, and drawn to an enlarged scale, showing the cooperation between the beams telescopically received within the brackets, and further showing the means for achieving angularity between the cooperating vise jaws.
Figure 6:
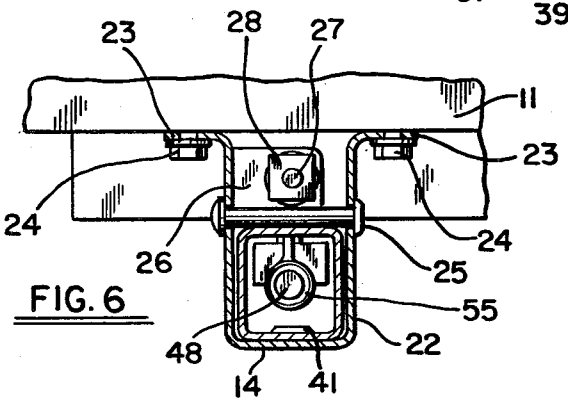
FIG. 6 is a stepped section view, taken along the lines 6—6 of FIG. 5, showing the manner in which the U-shaped brackets are secured to the underside of the table top.

With reference to FIGS. 5 and 6, a pair of spaced U-shaped brackets 22 are secured to the underside of the table top, one for each of the beams 14. The brackets and beams are identical, as is the means for actuating the movable front vise jaw; hence only one of the assemblies will be described. With this in mind, the beam is tubular and square cross-sectioned (as shown more clearly in FIG. 6) and is slidably received telescopically within the bracket. The bracket has laterally-extending side flanges 23 secured to the underside of the table top by screws 24. The legs of the bracket are connected by a supporting rivet 25, which provides part of the guiding means for the slidable beam. One of the legs of the bracket has a tab 26 bent at right angles thereto, and the fixed rear vise jaw is secured to the bracket tab by means of a bolt 27 and nut 28. The beam has a lower longitudinal side 29 provided with a lanced-out depending tab 30, thereby precluding the beam from being entirely removed forwardly of the bracket. Preferably, the brackets and beams are fabricated economically as sheet-metal stampings.

An indexing means 31 is provided between the beam and the bracket. This indexing means includes a cylindrical cap 32, preferably of molded construction, having an annular flange 33 retained to the underside of the bracket by means of a pair of offset tabs 34 welded to the bracket. A locating pin 35 is mounted coaxially within the cap and is resilient biased by means of a spring 36. The spring is seated between the cap and a flanged disc 37 engaging an annular shoulder 38 on the pin. The pin is secured to a knurled knob 39, preferably of molded construction, and cooperating cam surfaces 40 are formed between the cap and the knob. As the knob is rotated, and because of the cooperating cam surfaces, the knob will be retracted away from the bracket and against the force of the spring. Thus, a convenient manual manipulation of the knob is facilitated to release the pin. The pin, which is carried by the knob, has an enlarged pilot portion 41 adapted to be received in a selected one of a plurality of spaced apertures 42 formed in the lower longitudinal side of the beam. Thus a quick or "coarse" adjustment is provided between the beam and its cooperating bracket. The specifics of the preferred indexing means, however, form no part of the present invention, being disclosed more particularly in FIGS. 12 and 13 of the aforesaid U.S. Pat. No. 4,154,435.

The fixed rear vise jaw has a relatively-narrow longitudinal side edge 43 disposed above the beams and further has a relatively-wide longitudinal flat side 44 abutting against the bracket and against the longitudinal front edge of the table top (as previously described). The movable front vise jaw includes a first member 45 of substantially identical dimensions as the fixed rear vise jaw. Preferably, both the fixed rear vise jaw and the member 45 are made of the hard wood or of a structural foam plastic. This assures that when the vise is used as a carpenter's vise or wood vise, that the workpieces will not be marred. However, when the vise is used as a machinist's vise, protective covers (not shown herein) may be used for the jaws. The movable front vise jaw further includes a substantially triangular cross-sectioned second member 46 (preferably made of stamped-sheet metal, such as steel) and is secured to the first member 45 by a screw 47 received within an opening 47*a* in the second member, the opening being punch-extruded and then tapped. This second member provides additional strength and rigidity for the movable vise jaw.

A pair of independently-operable screw-threaded rods 48 are mounted within the respective beams and are connected to the respective crank handles. An enlarged thrust collar 49, preferably molded from a suitable plastic material, is secured to the rod by means of a roll pin 50. The rod extends beyond a square cap 51 secured on the end of the beam by means of screws (not shown). The crank handle includes portions 52 and 53 which are preferably molded from a suitable plastic material. Portion 52 of the handle is secured on the end of the rod by means of a pin 54, and portion 53 of the handle is snap-fitted into portion 52 in a well-known manner. This arrangement restrains the rod against axial movement thereof relative to the beam, yet accommodates rotatable movement of the rod within the beam. A substantially L-shaped pivot nut member 55 is secured to the second member of the movable front vise jaw by means of a screw 56, which is received in a punch-extruded tapped opening 57 formed in the second member; and the screw-threaded rods are received within the respective pivot nut members. With this overall structural arrangement, the movable front vise jaw may be moved in a non-parallel relationship to the fixed rear vise jaw for clamping tapered workpieces therebetween.

In a practical physical embodiment of the present invention, a workpiece as large as 8.5 inches wide may be positioned between the tubular beams, yet may be clamped by the cooperating vise jaws. The spaced apertures in the beams for cooperation with the spring-loaded pins carried by the respective brackets, constituting the indexing means, are spaced 1.5 inches apart on their centers. As the knob is rotated, the locating pin is easily retracted out of its aperture, thereby conveniently facilitating a quick or "coarse" adjustment of the beams with respect to the brackets, and hence the movable front vise jaw with respect to the fixed rear vise jaw. Thus, the vise can be quickly adjusted from its maximum to its minimum opening, and vise versa, and "fine" adjustment is obtained via the crank handles for exerting strong clamping pressure on a workpiece gripped by the vise jaws. Yet, because of the independently-operable screw-threaded rods and their cooperating pivot nuts, tapered or odd-shaped workpieces may be clamped between the jaws (as described in the aforesaid U.S. Pat. No. 4,154,435 covering one of the "WORKMATE" portable work centers and vises manufactured and sold by Black & Decker (U.S.) Inc.).

In summary, the vise of the present invention has the following desirable features and advantages: (1) easily mounted to a workbench, (2) large clamping capacity for relatively large workpieces, (3) a quick adjusting feature, (4) an angular clamping capability for tapered or odd-shaped workpieces, (5) "drop through" clamping without interference from a centrally-disposed rod, (6) facilitates a product line of various sizes using standardized components, and (7) facilitates low-cost manufacture and assembly. Accordingly, it will be appreciated that the objectives of the present invention have been fulfilled in a commercially-practical manner.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. For use with a workbench having a table top provided with a longitudinal front edge, a vise comprising a pair of spaced brackets secured to the underside of the table top, a pair of substantially-parallel tubular beams slidably received telescopically within the brackets, respectively, manually-manipulatable independently-operable indexing means between the beams and brackets, respectively, the indexing means including a spring-loaded pin carried by the bracket, a knob carried by the pin and projecting below the bracket, and the beam having a lower longitudinal side provided with a plurality of spaced apertures for receiving the pin, selectively, whereby a plurality of coarse adjustments is provided between the beams and brackets, respectively, a longitudinally-extending rear vise jaw disposed above the beams transversely thereof and abutting the lower portion of the longitudinal front edge of the table top, means fixing the rear vise jaw to the brackets, whereby the vise is cantilever mounted to the underside of the table top and projects forwardly thereof beneath the extended plane of the table top, a longitudinally-extending movable front jaw slidably disposed on top of the beams transversely thereof, and means mounting the movable front vise jaw on the respective beams for movement towards and away from the fixed rear vise jaw, thereby providing for a fine adjustment in the clamping pressure exerted on a workpiece positioned between the jaws.

2. For use with a workbench having a table top provided with a longitudinal front edge, a vise comprising a pair of spaced U-shaped brackets having respective flanges secured to the underside of the table top, a pair of substantially-parallel square cross-sectioned tubular beams slidably received telescopically within the brackets, respectively, respective stop means precluding the beams from being completely removed from the brackets forwardly thereof, manually-manipulatable independently-operable indexing means including a spring-loaded pin carried by each bracket, a knob carried by the pin and projecting below the bracket, and the beam having a lower longitudinal side provided with a plurality of spaced apertures for receiving the pin, selectively, whereby a plurality of coarse adjustments is provided between the beams and brackets, respectively, a longitudinally-extending rear vise jaw having a relatively-narrow longitudinal side edge disposed above the beams transversely thereof, and further having a relatively-wide flat side abutting the lower portion of the longitudinal front edge of the table top, means fixing the rear vise jaw to the brackets, whereby the vise is cantilever mounted to the underside of the table top and projects forwardly thereof beneath the extended plane of the table top, a longitudinally-extending movable front jaw slidably disposed on top of the beams transversely thereof, the movable front vise jaw including a first member of substantially identical dimensions as the fixed rear vise jaw, and further including a supporting second member of tubular cross-section secured to the first member forwardly thereof, and means mounting the second member on the beams for movement of the movable front vise jaw towards and away from the fixed rear vise jaw in a non-parallel relationship thereto, whereby an odd-shaped or tapered workpiece positioned between the beams and disposed above and below the vise may be clamped between the vise jaws, the mounting means including respective pivot nut members carried by the underside of the second member of the movable front vise jaw, the beams having top flat sides with respective longitudinal slots formed therein for receiving the nut members, respectively, a pair of independently-operable screw-threaded rods rotatably mounted within the respective beams and engaging the nut members, respectively, means restraining the rods against axial movement thereof relative to the respective beams, and a crank handle carried by each of the rods forwardly of the beams.

* * * * *